US006013115A

United States Patent [19]

Kanakia et al.

[11] Patent Number: 6,013,115

[45] Date of Patent: Jan. 11, 2000

[54] FUEL ADDITIVE COMPOSITIONS FOR SIMULTANEOUSLY REDUCING INTAKE VALVE AND COMBUSTION CHAMBER DEPOSITS

[75] Inventors: Michael D. Kanakia, New Fairfield; Ralph Franklin, Danbury, both of Conn.; Dale Steichen, Vastrafrolunda, Sweden; James F. Gadberry, Danbury, Conn.

[73] Assignee: Akzo N.V., Arnhem, Netherlands

[ * ] Notice: This patent is subject to a terminal disclaimer.

[21] Appl. No.: 09/136,675

[22] Filed: Aug. 19, 1998

Related U.S. Application Data

[63] Continuation-in-part of application No. 08/698,206, Aug. 14, 1996.

[51] Int. Cl.[7] ..... C10L 1/18; C10L 1/22

[52] U.S. Cl. ..... 44/391; 44/399

[58] Field of Search ..... 44/391, 399

[56] References Cited

U.S. PATENT DOCUMENTS

| | | |
|---|---|---|
| 2,110,274 | 3/1938 | Mikeska et al. . |
| 2,854,323 | 9/1958 | Shen et al. . |
| 3,063,819 | 11/1962 | Watt et al. . |
| 3,091,521 | 5/1963 | Liao et al. ..... 44/391 |
| 3,117,931 | 1/1964 | Westlund et al. . |
| 3,183,070 | 5/1965 | Udelhofen . |
| 3,240,575 | 3/1966 | Miller et al. . |
| 3,381,022 | 4/1968 | Le Suer . |
| 3,658,707 | 4/1972 | Delafield et al. . |
| 3,676,483 | 7/1972 | Hu . |
| 3,807,973 | 4/1974 | Iwama et al. . |
| 3,890,357 | 6/1975 | Rubin et al. . |
| 3,920,729 | 11/1975 | Sagawa et al. . |
| 3,957,854 | 5/1976 | Miller . |
| 4,002,569 | 1/1977 | Rubin et al. . |
| 4,204,481 | 5/1980 | Malec . |
| 4,234,435 | 11/1980 | Meinhardt et al. . |
| 4,622,047 | 11/1986 | Bernasconi et al. . |
| 4,639,256 | 1/1987 | Axelrod et al. . |
| 4,670,021 | 6/1987 | Nelson et al. . |
| 4,810,263 | 3/1989 | Zimmerman et al. . |
| 5,194,068 | 3/1993 | Mohr et al. . |
| 5,298,038 | 3/1994 | Hashimoto et al. ..... 44/433 |
| 5,407,452 | 4/1995 | Cherpeck . |
| 5,597,390 | 1/1997 | Loper . |

FOREIGN PATENT DOCUMENTS

| | | |
|---|---|---|
| 650405 | 11/1964 | Belgium . |
| 85803 | 8/1983 | European Pat. Off. . |
| 117108 | 3/1984 | European Pat. Off. . |
| 353713 | 2/1990 | European Pat. Off. . |
| 464489 | 1/1992 | European Pat. Off. . |
| 1211144 | 3/1960 | France . |
| 2576032 | 3/1986 | France . |
| 2144199 | 3/1973 | Germany . |
| 2559480 | 1/1977 | Germany . |
| 57-170993 | 10/1982 | Japan . |
| 59-189192 | 10/1984 | Japan . |
| 60-137998 | 7/1985 | Japan . |
| 60-166389 | 8/1985 | Japan . |
| 61-281198 | 12/1986 | Japan . |
| 62-109893 | 5/1987 | Japan . |
| 899261 | 6/1962 | United Kingdom . |
| 1062605 | 4/1967 | United Kingdom . |
| 1410788 | 10/1975 | United Kingdom . |
| 9303120 | 2/1993 | WIPO . |
| 9634177 | 10/1996 | WIPO . |

OTHER PUBLICATIONS

Owen, "Gasoline and Diesel Fuel Additives", *Critical Reports on Applied Chemistry,* vol. 25, pp. 23–33. Date unavailable.

*Primary Examiner*—Jacqueline V. Howard
*Attorney, Agent, or Firm*—Dilworth & Barrese

[57] ABSTRACT

Engine deposits are reduced by adding an effective deposit-controlling amount of esteramine to hydrocarbon fuel.

35 Claims, 2 Drawing Sheets

FUEL ADDITIVE COMPOSITIONS FOR SIMULTANEOUSLY REDUCING INTAKE VALVE AND COMBUSTION CHAMBER DEPOSITS

RELATED APPLICATION

This application is a continuation-in-part of U.S. application Ser. No. 08/698,206 filed Aug. 14, 1996, the entire contents of which are incorporated herein by reference.

BACKGROUND

1. Technical Field

This disclosure relates to fuel compositions containing deposit control additives and methods for reducing deposits on the surface of engine components and within the combustion chamber. More specifically, this disclosure relates to fuel compositions containing a deposit-controlling amount of esteramines to inhibit and control engine deposits.

2. Background of Related Art

It is well known that automobile engines tend to form deposits within the combustion chamber and on the surface of engine components, such as carburetor ports, throttle bodies, fuel injectors, intake ports, intake valves, piston tops, and cylinder heads due to the evaporation, oxidation and polymerization of hydrocarbon fuel. These deposits, even when present in relatively minor amounts, often cause noticeable driveability problems, such as stalling and poor acceleration. Moreover, engine deposits can significantly increase an automobile's fuel consumption and production of exhaust pollutants. Therefore, the development of effective fuel detergents or "deposit control" additives to prevent or control such deposits is of considerable importance.

During engine operation, the fuel composition is exposed to a variety of conditions which can potentially result in deposit formation. For example, at a fuel injector, relatively low temperature conditions may result in deposits. At the intake valve, deposits form at somewhat higher temperature conditions, with the fuel composition experiencing significant fluctuations in temperature and pressure being as the valve opens and closes. Within the combustion chamber, the fuel composition is exposed to high temperature that can result in deposits. The nature of the deposit formed at each component is different due to the different conditions under which the deposit was produced. Accordingly, one type of additive might prevent, inhibit and/or remove deposit formation at a fuel injector, but that same additive might be ineffective at preventing, inhibiting or removing deposits within the combustion chamber. For example, a polyetheramine fuel additive is commercially available under the designation Techron from Chevron Corp. While this polyetheramine product is effective at reducing intake valve deposits, combustion chamber deposits actually increase as a result of using the polyetheramine additive. It would be desirable to provide a fuel additive that simultaneously reduces both intake valve and combustion chamber deposits.

It has now been discovered that certain esteramines are surprisingly useful for reducing engine deposits when employed as fuel additives in fuel compositions.

SUMMARY

Novel fuel compositions described herein comprise a major amount of fuel and an effective deposit-controlling amount of an additive composition that provides a simultaneous reduction in intake valve deposits and combustion chamber deposits. The additive composition contains at least one esteramine of the general formula:

$$(R^1\text{—}\overset{\overset{\displaystyle O}{\|}}{C}O\text{—}R^2)_xNR_y^3R^4_z$$

wherein $R^1$ is a $C_{12}$–$C_{18}$ hydrocarbon group, preferably a $C_7$–$C_{21}$ saturated or unsaturated alkyl group, most preferably a $C_{16}$–$C_{18}$ straight chain alkyl group; x is 1 or 2; y and z are individually selected from 0, 1 or 2; x+y+z=3; $R^2$ is selected from the group consisting of $C_1$–$C_6$ alkylene groups and —$(R^5O)_nR^5$— groups wherein each $R^5$ can be the same or different and is independently selected from the group consisting of linear or branched $C_1$–$C_6$ alkylene groups and n is 1 to 60, $R^3$ and $R^4$ can be the same or different and are individually selected from the group consisting of $C_1$–$C_6$ alkyl groups and —$(R^5O)_nH$ groups wherein $R^5$ and n are as defined above. When the additive composition contains a mixture of monoestermine and diesteramine, the amount of monoester present is less than about 20% based on the total amount of esteramine present. The amount of unsaturation as measured by Iodine Value for the esteramines is less than about I.V. 70.

In particularly useful embodiments, the esteramine is prepared by reacting a fatty acid with methyldiethanolamine. The esteramine produced will be a diesteramine or a mixture of monoesteramine and diesteramine. The additive composition can contain only the estermine(s) or the estermine(s) in combination with other deposit-control additives.

Methods for reducing engine deposits in an internal combustion engine are also described. The methods comprise operating an engine with a fuel comprising an effective deposit-controlling amount of an additive composition at least one esteramine as described above.

BRIEF DESCRIPTIONS OF THE DRAWINGS

Various embodiments are described herein with reference to the drawings wherein:

FIG. 1 is a graph depicting measured engine intake valve deposits resulting from 80 hour operation of a four cycle engine using fuel containing various additive compositions, including presently described esteramine deposit control additive compositions; and FIG. 2 is a graph depicting measured engine deposits resulting from 80 hour operation of four cycle engine using fuel containing various additive compositions, including presently described esteramine deposit control additive compositions and showing the synergistic effects obtained when the presently described deposit control additives are combined with a known polyetheramine additive.

DETAILED DESCRIPTION OF PREFERRED EMBODIMENTS

Figure 1:
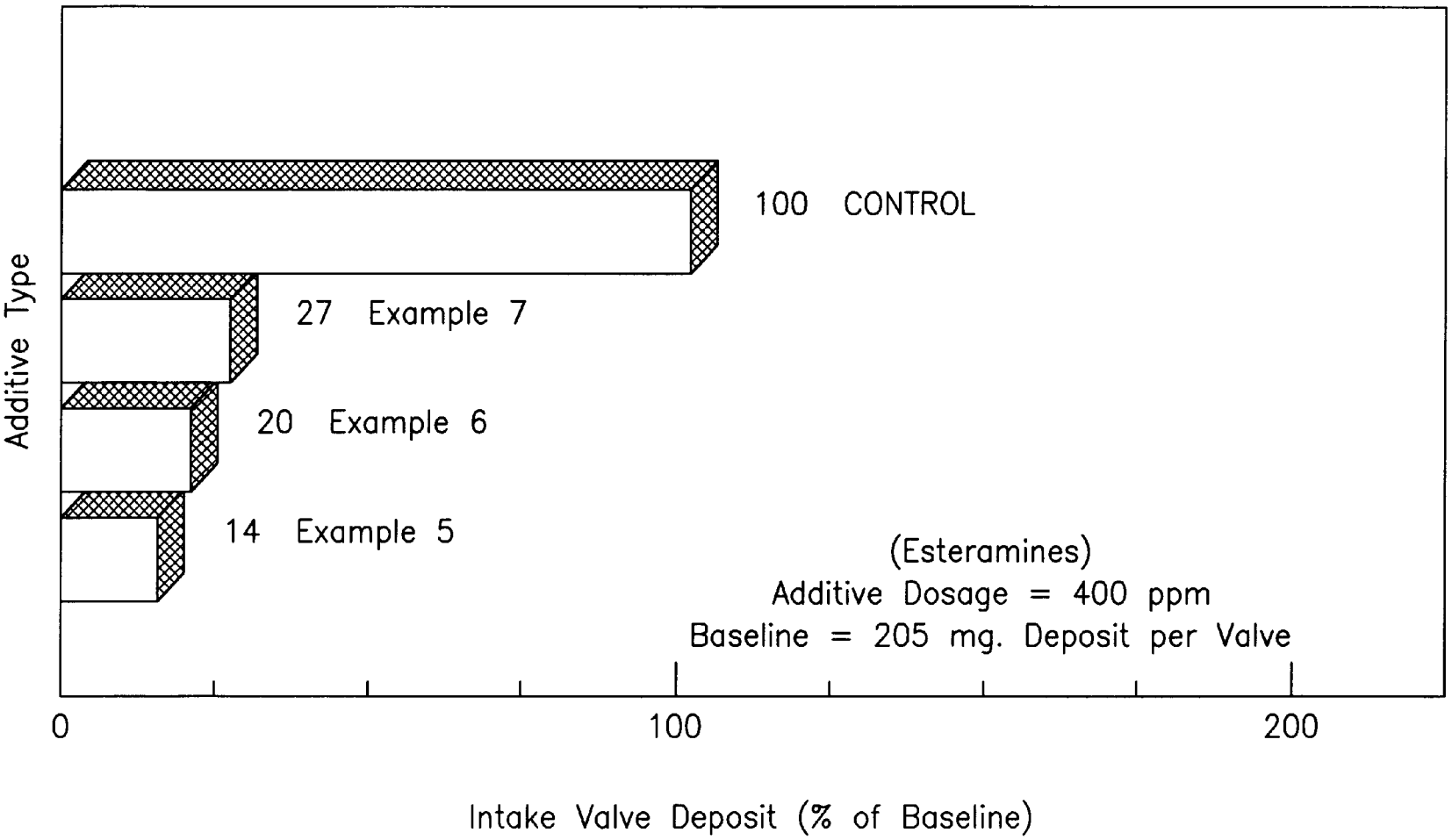

The fuel compositions described herein contain a major amount of gasoline or diesel fuel and an effective deposit-controlling amount of an additive composition that provides a simultaneous reduction in intake valve deposits and combustion chamber deposits. The additive composition contains at least one esteramine. The esteramine is of the general formula:

$$(R^1-\overset{\overset{\displaystyle O}{\|}}{C}O-R^2)_xNR_y^3R^4_z$$

wherein $R^1$ is a $C_{12}$–$C_{18}$ hydrocarbon group, preferably a $C_{12}$–$C_{18}$ saturated or unsaturated alkyl group, most preferably a $C_{16}$–$C_{18}$ straight chain saturated or unsaturated alkyl group; x is 1 or 2; y and z are individually selected from 0, 1 or 2; x+y+z=3; $R^2$ is selected from the group consisting of $C_1$–$C_6$ alkylene groups (preferably $C_1$–$C_4$ alkylene groups) and —$(R^5O)_nR^5$— groups wherein each $R^5$ can be the same or different and is individually selected from the group consisting of linear or branched $C_1$–$C_6$ alkylene groups (preferably $C_1$–$C_4$ allylene groups) and n is 1 to 60, $R^3$ and $R^4$ can be the same or different and are individually selected from the group consisting of $C_1$–$C_6$ alkyl groups (preferably $C_1$–$C_4$ alkylene groups) and —$(R^5O)_nH$ groups wherein $R^5$ and n are as defined above.

Where the additive composition contains a mixture of esteramines, the additive composition contains up to about 20 percent by weight of the monoester amine, i.e., compounds of the general formula given above where x=1. It has surprisingly been found that a simultaneous reduction in intake valve deposits and combustion chamber deposits is significantly less likely to occur if more than about 20 percent of the monoester is present. Preferably, the amount of monoester is less than about 15%. Most preferably, less than 10% by weight of the estermine present is monoester.

The esteramine contained in the additive composition should also have an Iodine Valve of less than about 70. As those skilled in the art will appreciate, Iodine Value ("I.V.") is a measure of unsaturation. If the I.V. of the esteramine is greater than about 70, a reduction of both intake valve deposits and combustion chamber deposits may not be observed. Preferably, the esteramine has an I.V. of less than about 50. Most preferably, the esteramine has an I.V. of less than 20.

In particularly preferred compositions, the deposit-reducing additive includes a mixture of monoesteramines and diesteramines of the formula $$(R-C-\overset{\overset{\displaystyle O}{\|}}{O}-CH_2CH_2)_x-N-(R^1)_y$$

wherein R is a $C_{12}$–$C_{18}$ hydrocarbon group, preferably a $C_{12}$–$C_{18}$ saturated or unsaturated alkyl group, x is 1 or 2 and x+y=3, $R^1$ is the same or different at each occurrence and is selected from the group consisting of —$CH_3$ and —$CH_2CH_2OH$. The ratio of diester to monoester in the additive composition is at least 4:1, preferably at least 9:1 most preferably between about 19:1 and 11.5:1. The degree of unsaturation as measured by Iodine Value is no greater than about I.V. 65, preferably no greater than about I.V. 35 most preferably between about 5 and about 20.

In particularly useful embodiments, the esteramine is prepared by reacting a fatty acid with an methyldialkanolamine. The fatty acid may be hydrogenated and is preferably a saturated fatty acid. Long chain fatty acids having 12 carbon atoms or more are particularly preferred for use in making the esteramine. Most preferred are long chain fatty acids having 16 to 18 carbon atoms, e.g., the tallow acids, including hydrogenated and partially hydrogenated tallow.

The fatty acid is reacted with an alkanolamine to provide an esteramine. Preferably, amines having two active sites are employed to produce a mixture of mono- and di-esters. Thus, for example, methydiethanolamine will produce a diester or a mixture of mono- and diester when reacted with the fatty acid. The conditions under which amines can be reacted with fatty acids to produce the present esteramines are known to those skilled in the art. Such reaction conditions are disclosed, for example, in PCT Publication No. WO91/01295, the disclosure of which is incorporated herein by this reference.

It is also possible to employ an alkoxylated amine or alkoxylated polyamine in preparing the present esteramine additives. Thus, for example, amines having one or more $(R^5O)_nH$ groups wherein $R^5$ and n are as mentioned above can be used as a starting material to produce the present esteramine deposit control additives. Such alkoxylated amines are available, for example, under the names Propomeen® and Ethomeen® from Akzo Nobel Chemicals Inc., Chicago, Ill. Preferably $R^5$ is selected from ethylene, propylene and mixtures thereof The conditions under which alkoxylated amines are reacted with fatty acids to produce esteramines are also known and are described, for example, in U.S. Pat. No. 5,523,433, the disclosure of which is incorporated by reference.

Esteramines suitable for use in connection with the fuel compositions and methods described in this disclosure should be soluble in the fuel and should not impart excessive water sensitivity to the fuel. Esteramines useful in the present invention are available from Akzo Nobel Chemicals Inc., Chicago, Ill.

The present fuel compositions contain an effective deposit-controlling amount of esteramine additives. The exact amount of additive that is effective in controlling deposits will depend on a variety of factors including the type of fuel employed, the type of engine and the presence of other fuel additives.

In general, the concentration of the esteramines in hydrocarbon fuel will range from about 50 to about 2500 parts per million (ppm) by weight, preferably from 75 to 1,000 ppm, more preferably from 200 to 500 ppm. When other deposit control additives are present, a lesser amount of the present additive may be used.

The present esteramine additives may also be formulated as a concentrate using an inert stable oleophilic (i.e., dissolves in gasoline) organic solvent boiling in the range of about 150° F. to 400° F. (about 65° C. to 205° C.). Preferably, an aliphatic or an aromatic hydrocarbon solvent is used, such as benzene, toluene, xylene or high-boiling aromatics or aromatic thinners. Aliphatic alcohols containing about 3 to 8 carbon atoms, such as isopropanol, isobutylcarbinol, n-butanol and the like, in combination with hydrocarbon solvents are also suitable for use with the present additives. In the concentrate, the amount of the additive will generally range from about 10 to about 70 weight percent, preferably to 50 weight percent, more preferably from 20 to 40 weight percent.

In gasoline fuels, other fuel additives may be employed with the additives of the present invention, including, for example, oxygenates, such as t-butyl methyl ether, anti-knock agents, such as methylcyclopentadienyl manganese tricarbonyl, and other dispersants/detergents, such as hydrocarbyl amines, hydrocarbyl poly-(oxyalkylene) amines, or succinimides. Additionally, antioxidants, metal deactivators and demulsifiers may be present.

A fuel-soluble, nonvolatile carrier fluid or oil may also be used with the esteramine additives described herein. The carrier fluid is a chemically inert hydrocarbon-soluble liquid vehicle which substantially increases the nonvolatile residue (NVR), or solvent-free liquid fraction of the fuel additive composition while not overwhelmingly contributing to octane requirement increase. The carrier fluid may be a natural or synthetic oil, such as mineral oil, refined petroleum oils, synthetic polyalkanes and alkenes, including hydrogenated and unhydrogenated polyalphaolefins, synthetic polyoxyalkylene-derived oils, esters and polyesters.

The carriers fluids are typically employed in amounts ranging from about 150 to about 5000 ppm by weight of the hydrocarbon fuel, preferably from 400 to 3000 ppm of the fuel. Preferably, the ratio of carrier fluid to deposit control additive will range from about 0.5:1 to about 10 1, more preferably from 1:1 to 4:1, most preferably about 2:1.

When employed in a fuel concentrate, carrier fluids will generally be present in amounts ranging from about 20 to about 60 weight percent, preferably from 30 to 50 weight percent.

EXAMPLES

The following examples are presented to illustrate specific embodiments of the present compositions and methods. These examples should not be interpreted as limitations upon the scope of the invention.

In the following examples, references to Esteramines I–III relate to the following compounds:

I. N-Methyldiethanolamine di(hydrogenated tallowate) ester

II. N-Methyldiethanolamine ditallowate ester I.V.=50

III. Alkoxylated methylamine ditallowate ester

Examples 1–4

Esteramine I was used to formulate fuel compositions which were tested to evaluate the tendency of the fuel compositions to form deposits on heated metal surfaces.

The compositions were evaluated using an induction system deposit (ISD) apparatus which is a bench-scale analytical laboratory tool that simulates two essential conditions that occur in the gasoline induction systems of spark-ignition engines: high temperature and thin film oxidation of atomized gasoline. In an ISD test, a fuel/air mixture is aspirated onto the outer surface of a internally heated metal deposit tube, in a flat spray pattern. This produces a roughly elliptical deposit on the cylindrical tube surface which can be weighed and visually evaluated. Test results from additized fuels can be interpreted as an indication of the relative effectiveness of the additives at reducing the deposit forming tendency of the fuel in a simulated induction system environment.

Additized samples for the ISD test were prepared by taking appropriate aliquots from 10 g/l stock solutions of the additives in the test fuel. 150 g of each sample was prepared and filtered through a 0.8 micro-meter membrane filter. Immediately after filtration, 150 ml of each test sample was tested on the ISD apparatus. Test data was recorded as deposit weight to nearest 0.1 mg. Tabulated data for additized fuel was presented as the percent of the "baseline" deposit produced by the unadditized test fuel.

% of Baseline=mg deposit (additized fuel)/mg deposit (unadditized fuel)×100

| The test parameters used for all the tests are as follows: | |
|---|---|
| Test Temp. | 450° F. (232° C.) |
| Sample Size | 150 ml |

-continued

| The test parameters used for all the tests are as follows: | |
|---|---|
| Fuel Flow Rate | 2 ml/min |
| Air Flow Rate | 15 l/min |
| Cylinder Material | Aluminum |
| Test Fuel | Formulated by Phillips Petroleum Co. for port injector fouling tests |

The results which are presented in Table I, show that Esteramine I reduced the fuel deposit about 45% of the level produced with unadditized fuel when they are used by themselves at 300 ppm by weight in the test fuel. When used in combination with a solvent neutral oil, the deposit reduction is significantly improved. (See Examples 2–4 in Table I.)

TABLE 1

| | Ex. 1 | Ex. 2 | Ex. 3 | Ex. 4 | Ex. A |
|---|---|---|---|---|---|
| Esteramine I | 300* | 300 | 300 | 150 | |
| Solvent Neutral Oil** | — | 500 | 500 | 500 | 500 |
| ISD Deposit (% of Baseline) | 42 | 11 | 15 | 28 | 58 |

*Additive Concentration is given asa ppm by weight in test fuel.
**The Solvent Neutral Oil used was Kendex 600, Kendex/Amali Div. of Witco Corp.

* Additive Concentration is given as ppm by weight in test fuel.
** The Solvent Neutral Oil used was Kendex 600, Kendex/Amali Div. of Witco Corp.

Examples 5–7

Fuel compositions containing esteramine additives I, II and III were formulated and tested to evaluate the additive's effectiveness at reducing deposits in an operating engine. The fuel compositions identified in Table II were used to operate pre-cleaned Honda Genset Engines for 80 hours. The engines were then disassembled and any deposits on the underside of the inlet valves were carefully removed and weighed. Any deposits on the piston top and combustion chamber of these four-cycle engines were also carefully collected and weighed. A baseline was established by operating a Honda Genset Engine using a test fuel containing no additives. The results are reported in Table II and are graphically depicted in FIG. 1.

TABLE II

| Example | Additive | Combustion Chamber Deposit (g) | Intake Valve Deposit (mg) | Intake Valve Deposit (% of Base-line) |
|---|---|---|---|---|
| CONTROL | NONE | 1.2 | 205 | 100% |
| 5 | Esteramine I | 1.3 | 29 | 14% |
| 6 | Esteramine II | 0.7 | 41 | 20% |
| 7 | Esteramine III | 1.2 | 55 | 27% |

In each case the concentration of the identified additive was 400 ppm and 500 ppm of a neutral solvent oil was also used.

As is evident from the values reported in Table II, the present esteramine additives reduced intake valve deposits by a minimum of about half to as much as 86% compared to the amount of deposit produced by non-additized fuel.

Examples 8 and 9

Fuel compositions were prepared by adding 400 ppm of the Esteramine I to two different commercial fuels; namely Shell 87 octane regular unleaded gas and Exxon 87 octane regular unleaded gas. The chemical make-up of any additive package already in the commercial fuels was unknown. Each fuel composition was used to operate a Honda Genset Engine for 80 hours. Then, any deposits formed in the intake valve and combustion chamber were carefully removed and weighed as previously described. For comparison purposes the commercial fuels were tested without the addition of the present esteramine additives. The results are reported in Table III.

TABLE III

| Example No | Composition | Intake Valve Deposit (mg) | Combustion Chamber Deposit (g) |
|---|---|---|---|
| Control | Shell Regular Gas (unleaded) | 0.0 | 1.9 |
| Example 8 | Shell Regular Gas Plus Esteramine I | 0.0 | 1.1 |
| Control | Exxon Regular Gas (unleaded) | 38 | 2.5 |
| Example 9 | Exxon Regular Gas Plus Esteramine I | 2.5 | 1.3 |

As the data in Table III show, the present esteramine additives significantly enhance any deposit control additives contained in the commercially available fuels tested.

Examples 10 and 11

The unexpected synergistic effects of the present esteramines when combined with a known polyetheramine additive were shown as follows: An 87 octane base fuel containing no additives was tested in the manner previously described to establish a baseline of deposits at the intake valve and combustion chamber of a four cycle engine. An esteramine deposit control additive in accordance with this disclosure (Esteramine I) was added to the base fuel to a concentration of 300 ppm and tested in the manner previously described to determine the amount of intake valve and combustion chamber deposits generated. A similar fuel composition containing the base fuel and 400 ppm of a polyetheramine additive that is commercially available under the name Techron from Chevron Corp. was also tested. Finally, a fuel composition containing the base fuel, 200 ppm of Esteramine I and 300 ppm polyetheramine was prepared and tested. The results are summarized in Table IV and graphically depicted in FIG. 2.

TABLE IV

| Example No | Composition | In the Valve Deposit (mg) | Combustion Chamber Deposit (g) |
|---|---|---|---|
| Control | None | 205 | 1.2 |
| 10 | Esteramine I | 24 | 1.3 |
| Control | Polyetheramine | 6.3 | 2.2 |
| 11 | Esteramine I plus Polyetheramine | 1.3 | 1.4 |

Figure 2:
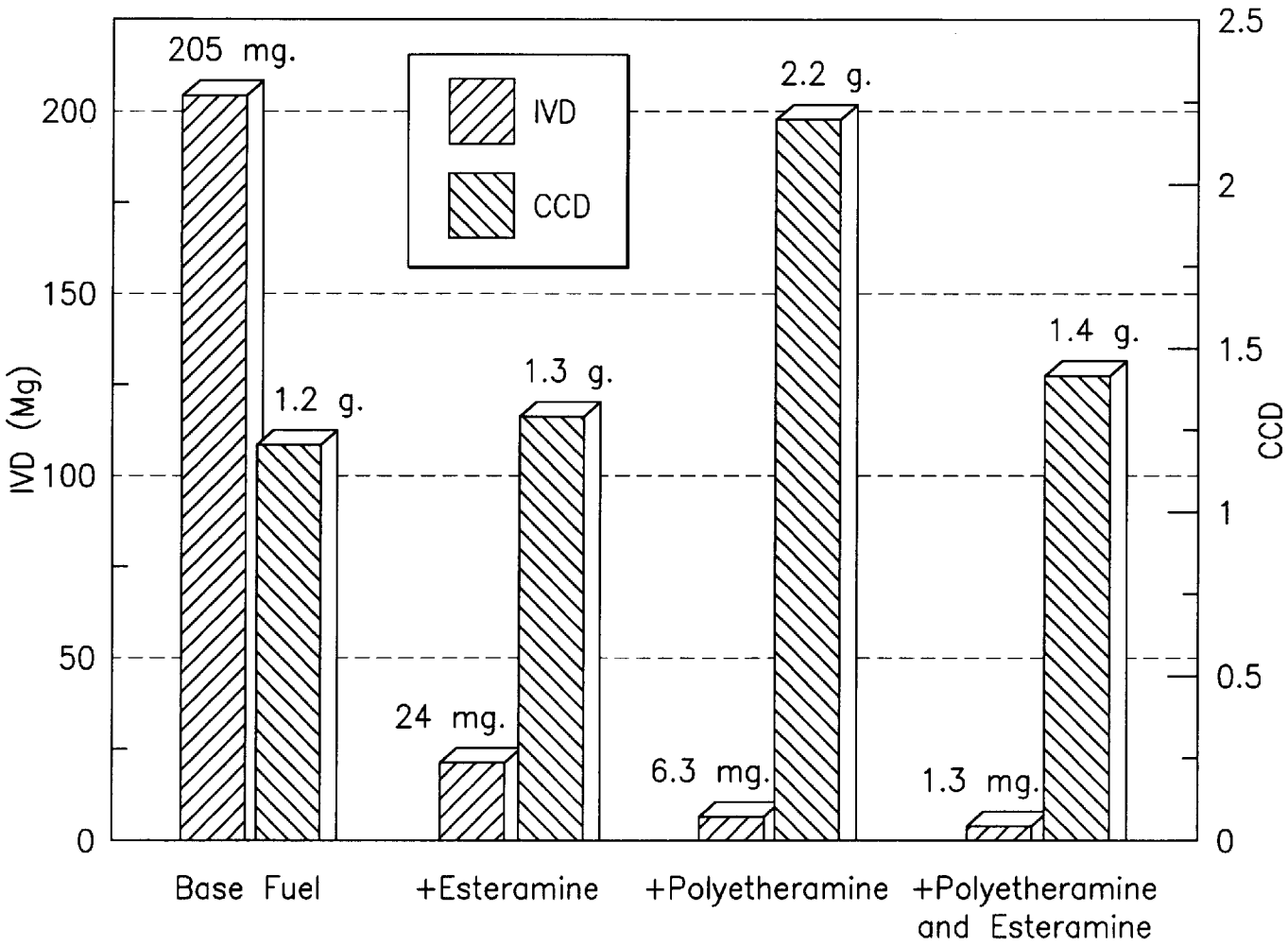

As the data in Table IV and FIG. 2 show, with respect to intake valve deposits the combined effects of the present esteramine additive and known polyether additive is greater than either of the additives individually.

Examples 12–27

Mixtures of monoesteramine and diesteramine were added to gasoline as a deposit control additive. The monoesteramines were of the general formula:

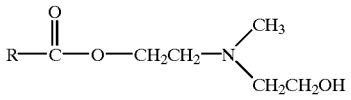

The diesteramines were of the general formula:

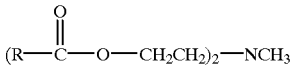

wherein R is either coco, tallow or 50:50 mixture of coco and tallow alkyl as indicated in Table V. The esteramines were prepared by reacting methyldiethanolamine with respective straight chain fatty acids as indicated. The amount of monoester in each mixture is also indicated in Table V. The degree of unsaturation for each esteramine mixture was measured using known techniques and is reported as IV in Table V. In each case, the concentration of the additive was 400 ppm and the 500 ppm of solvent neutral oil was also used. Each fuel composition was used to operate a Honda Genset Engine for 80 hours. Then, any deposits formed in the intake valves and combustion chamber were carefully removed and weighed as previously described. A baseline was established by operating a Honda Genset Engine using a test fuel containing no additives. The results are reported in Table V.

TABLE V

| Example | Monoester % | Fatty Acid* | IV | IVD % of Base | CCD % of Base |
|---|---|---|---|---|---|
| 12 | 2.80 | coco | 8.00 | 16.00 | 57.00 |
| 13 | 6.00 | coco | 8.00 | 14.00 | 45.00 |
| 14 | 6.00 | coco | 8.00 | 12.00 | 50.00 |
| 15 | 4.30 | tallow | 23.00 | 8.00 | 59.00 |
| 16 | 8.50 | tallow | 23.00 | 8.00 | 54.00 |
| 17 | 4.50 | coco-tallow | 9.80 | 8.00 | 46.00 |
| 18 | 7.10 | coco-tallow | 9.80 | 10.00 | 50.00 |
| 19 | 1.90 | coco-tallow | 29.00 | 12.00 | 50.00 |
| 20 | 10.20 | coco-tallow | 29.00 | 14.00 | 50.00 |
| 21 | 4.10 | coco | 8.00 | 12.00 | 48.00 |
| 22 | 6.80 | tallow | 11.90 | 10.00 | 48.00 |
| 23 | 3.00 | coco | 8.00 | 8.00 | 54.00 |
| 24 | 4.80 | tallow | 49.00 | 24.00 | 77.00 |
| 25 | 4.20 | coco-tallow | 29.00 | 7.00 | 53.00 |
| 26 | 3.70 | coco-tallow | 29.00 | 11.00 | 54.00 |
| 27 | 7.20 | coco-tallow | 29.00 | 5.00 | 55.00 |
| CONTROL | N/A | N/A | N/A | 100.00 | 100.00 |

*coco-tallow = 50:50 mixture of coco and tallow fatty acids

* coco-tallow=50:50 m of coco and tallow fatty acids

Based upon the data contained in Table V, it has been mathematically determined that in order to provide a simultaneous reduction in both combustion chamber deposits and intake valve deposits using a mixture of monoesteramine and diesteramine of the general formulas given above, it is critical that the monoester content be below about 20% and that the degree of unsaturation be below about IV 70. In view of the fact that intake valve deposits and combustion chamber deposits are formed under vastly different conditions, it is a quite surprising and unexpected result that a simultaneous reduction in both types of deposits can be achieved by a single composition having the aforementioned characteristics.

It will be understood that various modifications may be made to the embodiments disclosed herein. Therefore, the above description should not be construed as limiting, but merely as exemplifications of preferred embodiments. Those skilled in the art will envision other modifications within the scope and spirit of the claims appended hereto.

What is claimed is:

1. A method of reducing fuel deposits in a four cycle engine, the method comprising:

preparing a four cycle engine fuel composition by combining a major amount of hydrocarbon fuel selected from the group consisting of gasoline and diesel fuel with an effective deposit-controlling amount of an additive composition containing one or more esteramines of the formula:

$$(R^1\text{—}\overset{\overset{\displaystyle O}{\|}}{C}O\text{—}R^2)_xNR_y^3R^4_z$$

wherein $R^1$ is a $C_{12}$–$C_{18}$ hydrocarbon group; x is 1 or 2; y and z are individually selected from 0, 1 or 2; x+y+z=3; $R^2$ is selected from the group consisting of $C_1$–$C_6$ alkylene groups and —$(R^5O)_nR^5$— groups wherein each $R^5$ can be the same or different and is independently selected from the group consisting of linear or branched $C_1$–$C_6$ alkylene groups and n is 1 to 60, $R^3$ and $R^4$ can be the same or different and are individually selected from the group consisting of $C_1$–$C_6$ alkyl groups and —$(R^5O)_nH$ groups wherein $R^5$ and n are as defined above, provided that compounds wherein x=1 constitute less than about 20% based on the total weight of the one or more esteramines and the one or more esteramines have an I.V. of less than about 70; and operating a four cycle engine using the fuel composition.

2. A method as in claim 1 wherein $R^1$ in the formula of the one or more esteramines is a $C_{12}$ to $C_{18}$ saturated or unsaturated alkyl group.

3. A method as in claim 1 wherein $R^1$ in the formula of the one or more esteramines is derived from a $C_{16}$–$C_{18}$ saturated or unsaturated fatty acid.

4. A method as in claim 1 wherein the additive composition contains a mixture of monoesteramine and diesteramine.

5. A method as in claim 1 wherein the additive composition is added to the fuel at a concentration from about 50 to about 2500 ppm.

6. A method as in claim 1 wherein the additive composition is added to the fuel at a concentration from about 200 to about 500 ppm.

7. A method as in claim 1 wherein the one or more esteramines have an I.V. of less than about 50.

8. A method as in claim 1 wherein the one or more esteramines have an I.V. of less than about 20.

9. A method as in claim 1 wherein compounds wherein x=1 constitute less than about 10% based on the total weight of the one or more esteramines.

10. A method as in claim 1 wherein the additive composition further comprises a polyetheramine.

11. A method as in claim 1 wherein the one or more esteramines is prepared by reacting a fatty acid with an alkanolamine.

12. A method as in claim 11 wherein the fatty acid is selected from the group consisting of coco, tallow and hydrogenated tallow fatty acids and combinations thereof.

13. A method of reducing the tendency of a fuel to form deposits during operation of an engine using the fuel, comprising:

providing a hydrocarbon fuel selected from the group consisting of gasoline and diesel fuel; and adding to the hydrocarbon fuel an additive composition containing an effective deposit-controlling amount of one or more esteramines of the formula:

$$(R^1\text{—}\overset{\overset{\displaystyle O}{\|}}{C}O\text{—}R^2)_xNR_y^3R^4_z$$

wherein $R^1$ is a $C_{12}$–$C_{18}$ hydrocarbon group; x is 1 or 2, y and z are individually selected from 0, 1 or 2; x+y+z=3; $R^2$ is selected from the group consisting of $C_1$–$C_6$ alkylene groups and —$(R^5O)_nR^5$— groups wherein each $R^5$ can be the same or different and is independently selected from the group consisting of linear or branched $C_1$–$C_6$ alkylene groups and n is 1 to 60, $R^3$ and $R^4$ can be the same or different and are individually selected from the group consisting of $C_1$–$C_6$ alkyl groups and —$(R^5O)_nH$ groups wherein $R^5$ and n are as defined above, provided that compounds wherein x=1 constitute less than about 20% based on the total weight of the one or more esteramines and the one or more esteramines have an I.V. of less than about 70.

14. A method as in claim 13 wherein the $R^1$ in the formula of the one or more esteramines is a $C_{12}$–$C_{18}$ saturated or unsaturated alkyl group.

15. A method as in claim 13 wherein the $R^1$ in the formula of the one or more esteramines is derived from a $C_{16}$–$C_{18}$ saturated or unsaturated fatty acid.

16. A method as in claim 13 wherein the one or more esteramine includes a diesteramine.

17. A method as in claim 13 wherein the additive composition is added to the fuel at a concentration from about 50 to about 2500 ppm.

18. A method as in claim 13 wherein the additive composition is added to the fuel at a concentration from about 200 to about 500 ppm.

19. A method as in claim 13 further comprising the step of adding a polyetheramine to the hydrocarbon fuel.

20. A method as in claim 13 wherein the one or more esteramines is prepared by reacting a fatty acid with an alkanolamine.

21. A method as in claim 20 wherein the fatty acid is selected from the group consisting of coco, tallow, and hydrogenated tallow fatty acids and combinations thereof.

22. A fuel composition comprising:

a major amount of a hydrocarbon fuel selected from the group consisting of gasoline and diesel fuel; and an effective deposit-controlling amount of an additive composition containing one or more esteramines of the formula:

$$(R^1\text{—}\overset{\overset{\displaystyle O}{\|}}{C}O\text{—}R^2)_xNR_y^3R^4_z$$

wherein $R^1$ is a $C_{12}$–$C_{18}$ hydrocarbon group; x is 1 or 2, y and z are individually selected from 0, 1 or 2; x+y+z=3; $R^2$ is selected from the group consisting of $C_1$–$C_6$ alkylene groups and —$(R^5O)_nR^5$— groups wherein each $R^5$ can be the same or different and is independently selected from the group consisting of linear or branched $C_1$–$C_6$ alkylene groups and n is 1 to 60, $R^3$ and $R^4$ can be the same or different and are individually selected from the group consisting of $C_1$–$C_6$ alkyl groups and —$(R^5O)_nH$ groups wherein $R^5$ and n are as defined above, provided that compounds wherein x=1 constitute less than about 20% based on the total weight of the one or more esteramines and the one or more esteramines have an I.V. of less than about 70.

23. A fuel composition as in claim 22 wherein the $R^1$ in the formula of the one or more esteramines is a $C_{12}$ to $C_{18}$ saturated or unsaturated alkyl group.

24. A fuel composition as in claim 22 wherein the $R^1$ in the formula of the one or more esteramines is derived from a $C_{12}$–$C_{18}$ saturated or unsaturated fatty acid.

25. A fuel composition as in claim 22 wherein the one or more esteramines includes a diesteramine.

26. A fuel composition as in claim 22 wherein the additive composition is present at a concentration from about 50 to about 2500 ppm.

27. A fuel composition as in claim 22 wherein the additive composition is present at a concentration from about 200 to about 500 ppm.

28. A fuel composition as in claim 22 further comprising a polyetheramine.

29. A method as in claim 1 wherein the one or more esteramines includes an esteramine selected from the group consisting of:

N,N-Dimethylethanolamine cocoate ester,

N-Methyldiethanolamine di(hydrogenated tallowate) ester,

N-Methyldiethanolamine mono (hydrogenated tallowate) ester,

Triethanolamine ditallowate ester,

Triethanolamine monotallowate ester,

N-Methyldiethanolamine ditallowate ester, and

Alkoxylated methylamine ditallowate ester.

30. A method as in claim 13 wherein the one or more esteramines includes an esteramine selected from the group consisting of:

N,N-Dimethylethanolamine cocoate ester,

N-Methyldiethanolamine di(hydrogenated tallowate) ester,

N-Methyldiethanolamine mono(hydrogenated tallowate) ester,

Triethanolamine ditallowate ester,

Triethanolamine monotallowate ester,

N-Methyldiethanolamine ditallowate ester, and

Alkoxylated methylamine ditallowate ester.

31. A fuel composition as in claim 22 wherein the one or more esteramines includes an esteramine selected from the group consisting of:

N,N-Dimethylethanolamine cocoate ester,

N-Methyldiethanolamine di(hydrogenated tallowate) ester,

N-Methyldiethanolamine mono(hydrogenated tallowate) ester,

Triethanolamine ditallowate ester,

Triethanolamine monotallowate ester,

N-Methyldiethanolamine ditallowate ester,

Alkoxylated methylamine ditallowate ester, and mixtures thereof.

32. A method comprising:

providing a fuel composition containing a major amount of a hydrocarbon fuel selected from the group consisting of gasoline and diesel fuel and a minor amount of an additive composition containing one or more compounds of the general formula

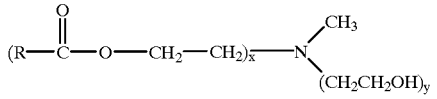

wherein x is 1 or 2; y is 0 or 1; x+y=2; R is $C_{12}$ to $C_{18}$ straight chain hydrocarbon group, wherein the additive composition contains less than about 20% by weight of a compound wherein x is 1 and the one or more compounds have a degree of unsaturation less than about IV 70; and operating a fuel-injected engine using the fuel composition to provide a simultaneous reduction in intake valve and combustion chamber deposits compared to an engine operated with fuel that does not contain the additive composition.

33. A method as in claim 32 wherein the one or more compounds is prepared by reacting a fatty acid with methyldiethanol amine.

34. A method as in claim 32 wherein the fuel composition further comprises a polyetheramine.

35. A fuel composition comprising:

a hydrocarbon fuel selected from the group consisting of gasoline and diesel fuel; and an effective deposit-controlling amount of an additive composition consisting essentially of a diesteramine of the formula

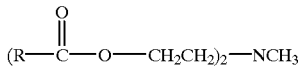

and up to 20 percent by weight based on the weight of the additive composition of a monoesteramine of the formula

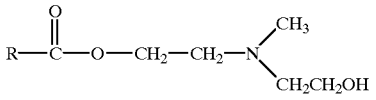

wherein R in each formula is a $C_{12}$–$C_{18}$ hydrocarbon group and the degree of unsaturation for the esteramines is less than about I.V. 70.

* * * * *